US006747560B2

(12) United States Patent
Stevens, III

(10) Patent No.: US 6,747,560 B2
(45) Date of Patent: Jun. 8, 2004

(54) SYSTEM AND METHOD OF DETECTING MOVEMENT OF AN ITEM

(75) Inventor: Harden E. Stevens, III, Lexington, SC (US)

(73) Assignee: NCR Corporation, Dayton, OH (US)

( * ) Notice: Subject to any disclaimer, the term of this patent is extended or adjusted under 35 U.S.C. 154(b) by 150 days.

(21) Appl. No.: 10/185,333

(22) Filed: Jun. 27, 2002

(65) Prior Publication Data

US 2004/0000997 A1 Jan. 1, 2004

(51) Int. Cl.[7] ..... G08B 13/14

(52) U.S. Cl. ..... 340/572.4; 340/825.36; 340/825.49; 340/5.92; 700/214; 700/215; 700/224; 700/225; 700/226; 700/227; 235/383; 235/385; 235/376

(58) Field of Search ..... 340/572.4, 825.36, 340/825.49, 5.92; 700/214, 215, 224, 225, 226, 227; 235/383, 385, 376

(56) References Cited

U.S. PATENT DOCUMENTS

| | | | | |
|---|---|---|---|---|
| 4,816,824 A | | 3/1989 | Katz et al. | |
| 5,151,684 A | | 9/1992 | Johnsen | |
| 5,239,167 A | | 8/1993 | Kipp | |
| 5,804,803 A | | 9/1998 | Cragun et al. | |
| 5,838,253 A | | 11/1998 | Wurz et al. | |
| 5,910,776 A | * | 6/1999 | Black | 340/10.1 |
| 5,962,834 A | | 10/1999 | Markman | |
| 5,963,134 A | | 10/1999 | Bowers et al. | |
| 6,019,394 A | | 2/2000 | Chenoweth et al. | |
| 6,127,928 A | * | 10/2000 | Issacman et al. | 340/572.1 |
| 6,169,483 B1 | * | 1/2001 | Ghaffari et al. | 340/572.3 |
| 6,259,367 B1 | | 7/2001 | Klein | |
| 6,286,763 B1 | | 9/2001 | Reynolds et al. | |
| 6,400,272 B1 | * | 6/2002 | Holtzman et al. | 340/572.1 |
| 6,600,418 B2 | * | 7/2003 | Francis et al. | 340/572.1 |
| 6,601,764 B1 | * | 8/2003 | Goodwin, III | 235/385 |

* cited by examiner

*Primary Examiner*—Daniel J. Wu
*Assistant Examiner*—Tai T. Nguyen
(74) *Attorney, Agent, or Firm*—Paul W. Martin

(57) ABSTRACT

A system for determining movement of an item bearing an RFID label. The system includes an RFID reader for receiving RFID label identification information from an RFID label associated with the item, and a computer for determining a location of the RFID label and the item by determining location information for the RFID reader, for determining a preferred location for the RFID label and the item, and for comparing the determined location with the preferred location to determine that the RFID label and the item have been moved.

17 Claims, 3 Drawing Sheets

SYSTEM AND METHOD OF DETECTING MOVEMENT OF AN ITEM

BACKGROUND OF THE INVENTION

The present invention relates generally to inventory management and, more specifically, to a system and method of detecting movement of an item is provided.

Radio frequency identification (RFID) technology provides an alternative to bar code reader technology for distinguishing and recording items for purchase. Some of the uses of RFID technology are disclosed in U.S. Pat. No. 6,019,394 assigned to the assignee of the present invention. This patent is hereby incorporated by reference.

Inventory management involves keeping track of where items are located. For example, retailers try to keep track of items on shelves and try to prevent theft of these items. In a business or office environment, office managers try to keep track of furniture, computers, and other office equipment and try to prevent unauthorized movement such equipment.

Therefore, it would be desirable to improve inventory management by providing a system and method of detecting movement of an item.

SUMMARY OF THE INVENTION

In accordance with the teachings of the present invention, a system and method of detecting movement of an item is provided.

The system includes an RFID reader for receiving RFID label identification information from an RFID label associated with the item, and a computer for determining a location of the RFID label and the item by determining location information for the RFID reader, for determining a preferred location for the RFID label and the item, and for comparing the determined location with the preferred location to determine that the RFID label and the item have been moved.

The method includes the steps of receiving RFID label identification information from an RFID label associated with the item through an RFID reader, determining a location of the RFID label and the item by determining location information for the RFID reader, determining a preferred location for the RFID label and the item, and comparing the determined location with the preferred location to determine that the RFID label and the item have been moved.

It is accordingly an object of the present invention to provide a system and method of detecting movement of an item.

It is another object of the present invention to provide a system and method of detecting movement of an item with an attached radio frequency identification (RFID) label.

It is another object of the present invention to provide a system and method of detecting improper removal of an item from a store.

It is another object of the present invention to provide a system and method of detecting a recall item.

It is another object of the present invention to provide a system and method of detecting movement of office equipment.

It is another object of the present invention to uniquely identify items and their movement by knowing locations of RFID readers that communicate with item RFID labels.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

DETAILED DESCRIPTION OF THE PREFERRED EMBODIMENT

Figure 1:
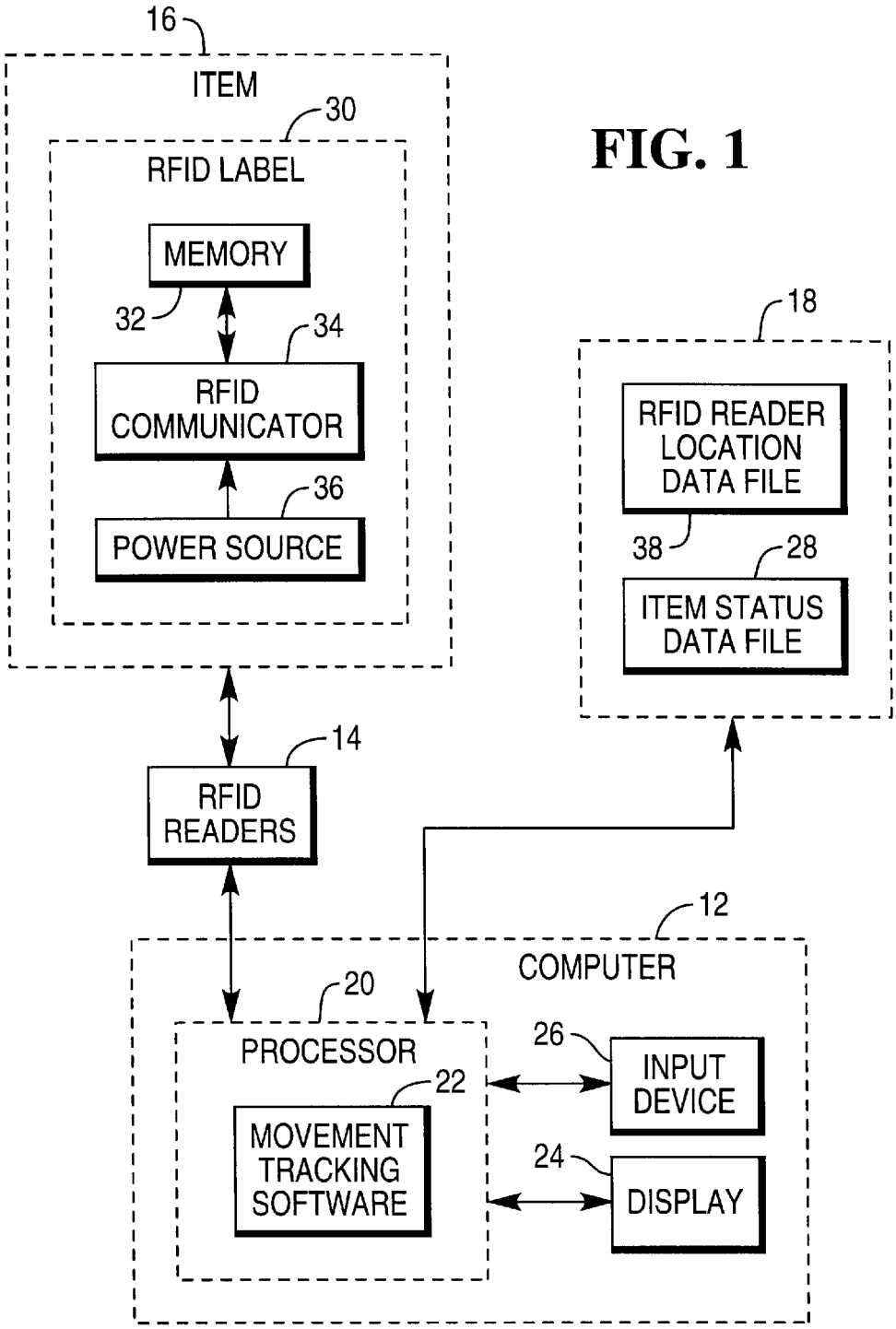
FIG. 1 is a block diagram of an item detecting system.

Referring now to FIG. 1, system 10 primarily includes computer 12 and radio frequency identification (RFID) readers 14.

Computer 12 includes processor 20, which executes movement tracking software 22. Movement tracking software 22 receives information from item 16 via RFID readers 14, determines the location of RFID readers 14 from RFID reader location data file 38, compares the location information to preferred item location information in item status data file 28, determines whether item 16 has been moved, determines from item status data file 28 whether item 16 has been moved to an inappropriate or unauthorized location, and alerts an operator through display 24.

Movement tracking software 22 can distinguish individual items 16 of a given type of items 16 because each item 16 is labeled with an RFID label 30 having unique RFID identification information. Movement tracking software 22 determines access information specific to each item 16 from item status data file 28.

For example, items 16 may be two identical laptop computers. One belongs to a person that has been authorized to remove the laptop from the business (to take it home or to travel with it). The other laptop computer belongs to a person that can only use it at work, in the office. In this case, the RFID label information controls which laptops can be removed from the building. If the laptop computer that cannot leave the office does leave the office, then an alert is sounded. If the laptop computer that can leave the office does leave the office, movement tracking software 22 logs the fact that the laptop computer was removed from the office and when.

Movement tracking software 22 can also track groups of items 16 by grouping identification information from their RFID labels 30 into defined groups in item status data file 28. In the example above, movement tracking software 22 can log the status of the two laptop computers as a group, e.g., common manufacturer. As another example, in a retail store, items 16 may be grouped by type, e.g., corn, by company, e.g., Proctor and Gamble, by category, e.g., low-fat items, or any other type of grouping desired.

Computer 12 may be located at a security station and be operated by security personnel. Computer 12 may also be the computer of the owner or person responsible for item 16.

Computer 12 additionally includes input device 26 to allow the operator to designate preferred location information. Input device 26 may include a keyboard or mouse or both.

RFID readers 14 communicate with RFID label 30 on item 16. RFID readers 14 may be located in both authorized and unauthorized item locations. The density of RFID readers 14 in a space may vary according to the level of security desired. Location information for RFID readers 14 is stored in RFID reader location data file 38.

For example, RFID readers 14 may be located at exits from authorized locations. In a business environment, RFID readers 14 may be located at office or building exits to identify office equipment or other items that have been moved from the office or building. In a retail environment, RFID readers 14 may be located at store exits to identify products that have been moved from the store without payment. RFID readers 14 at checkout terminals may help identify products that should not be sold due to recalls.

For tighter security, RFID readers 14 may be located at the authorized locations for item 16. If item 16 is not detected at the authorized location, then a security operator may assume that item 16 has been moved.

RFID label 30 stores RFID label identification information and may additional store item identification information about item 16. RFID label 30 communicates stored information to RFID readers 14.

One embodiment of RFID label 18 is active and includes memory 32, RFID communicator 34, and power source 36. RFID communicator 34 sends information stored in RFID memory 32 to RFID readers 14. RFID communicator 34 may include an RF transceiver.

Memory 32 stores the information and may include a read-only memory (ROM) for one-time use, or a programmable ROM (EPROM) for repeated use.

Power source 36 may include a battery.

In another embodiment, RFID label 30 is a passive label. Passive RFID labels use very little energy and may only include RFID communicator 34. Power may be derived from radio waves.

RFID communicator 34 may include a reflective antenna which has a frequency which is unique among different RFID labels 30. RFID communicator 34 communicates RFID label identification information which must be cross-referenced to obtain item identification information. RFID communicator 34 may include a number of antennas, such as conductive ink antennas.

RFID labels 30 may vary in size, depending upon product size, and may be visible or hidden when attached to items. RFID label 30 may be removably or permanently attached to items.

Storage medium 18 stores item status data file 28 and RFID reader location data file 38.

Figure 2:
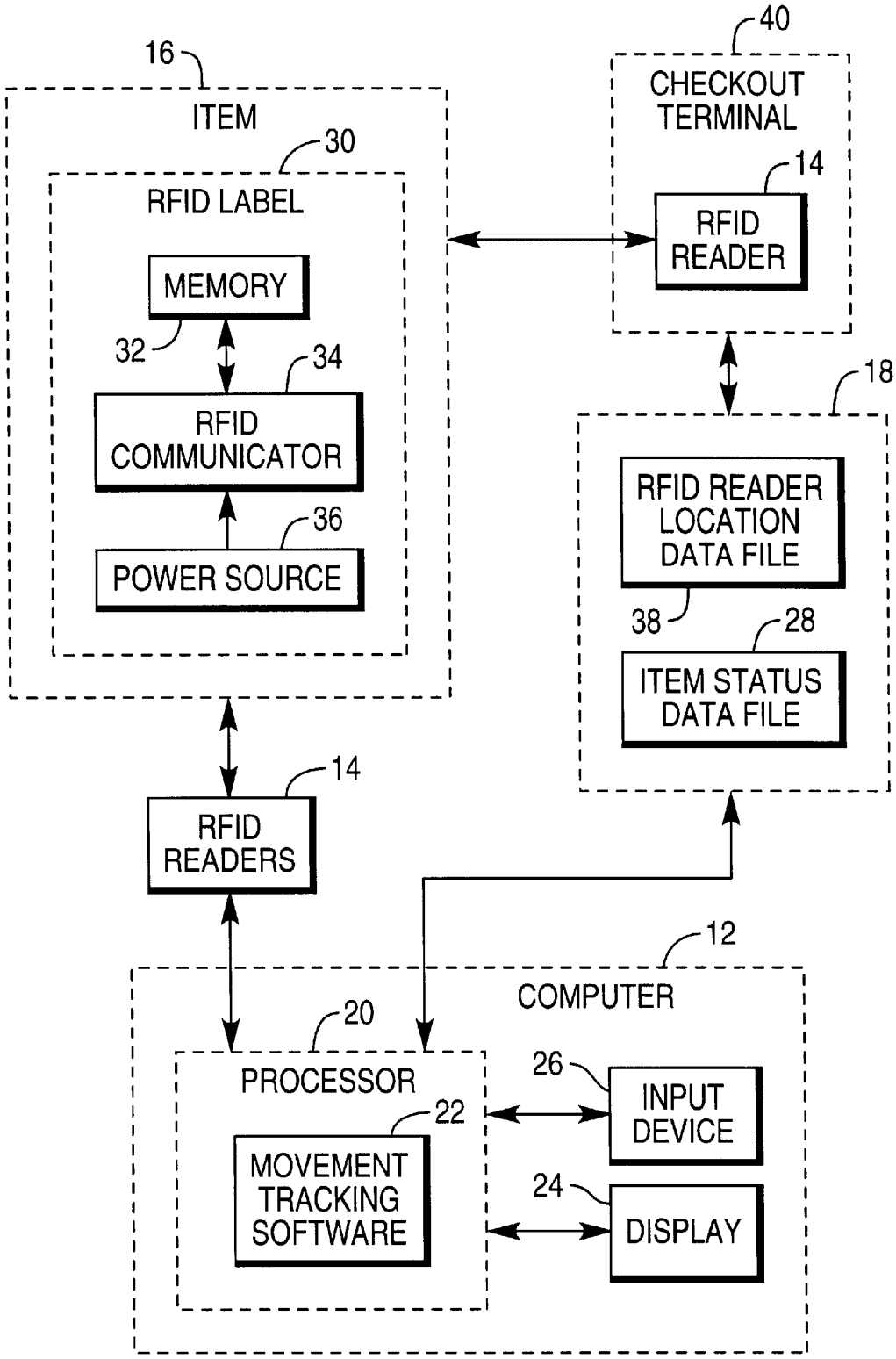
FIG. 2 is a block diagram of another item detecting system.

Turning now to FIG. 2, an example of system 10 in a retail environment is illustrated. System 10 has been modified to include checkout terminal 40

Checkout terminal 40 includes one of RFID readers 14 to read RFID label 30 one item 16 during checkout. Checkout terminal 40 obtains item identification information, either from RFID label 30, or from a different file, such as item status data file 28. After sale, checkout terminal 40 marks RFID label identification information in item status data file 28 as attached to a purchased item 16.

As the customer exits the store, movement tracking software 22 obtains RFID label identification information using readers 14 at the exits, reads item status data file 28 to determine whether the RFID label identification information is associated with a purchased item 16, and issues an alert if the RFID label identification information is not associated with a purchased item 16.

To implement recall procedures, computer 12 or checkout terminal 40 checks item status data file 28 to determine whether RFID label identification information associated with a product is marked as unavailable for sale due to recall. Recalled products can be collected before any sales are made.

To minimize fraud, one of RFID readers 14 may be located at packing locations, such as meat counters. When meat is cut, weighed and packaged, the scale conveys the weight to item status data file 28. RFID reader 14 conveys the RFID label identification information to item status data file 28 to be stored with the price and weight information. RFID reader 14 at checkout terminal 40 reads an RFID label 30 on the packaged meat. Checkout terminal 40 accesses item status data file 28 to determine the price and weight for the item 16 associated with the RFID identification information. The packaged meat is reweighed at checkout terminal 40 and checkout terminal 40 compares the current weight with the stored weight. This would prevent a shopper from changing packing labels. Even if RFID label 30 is in the packing label, checkout terminal 40 would be able to detect fraud because the weight of the packaged meat would be wrong.

Figure 3:
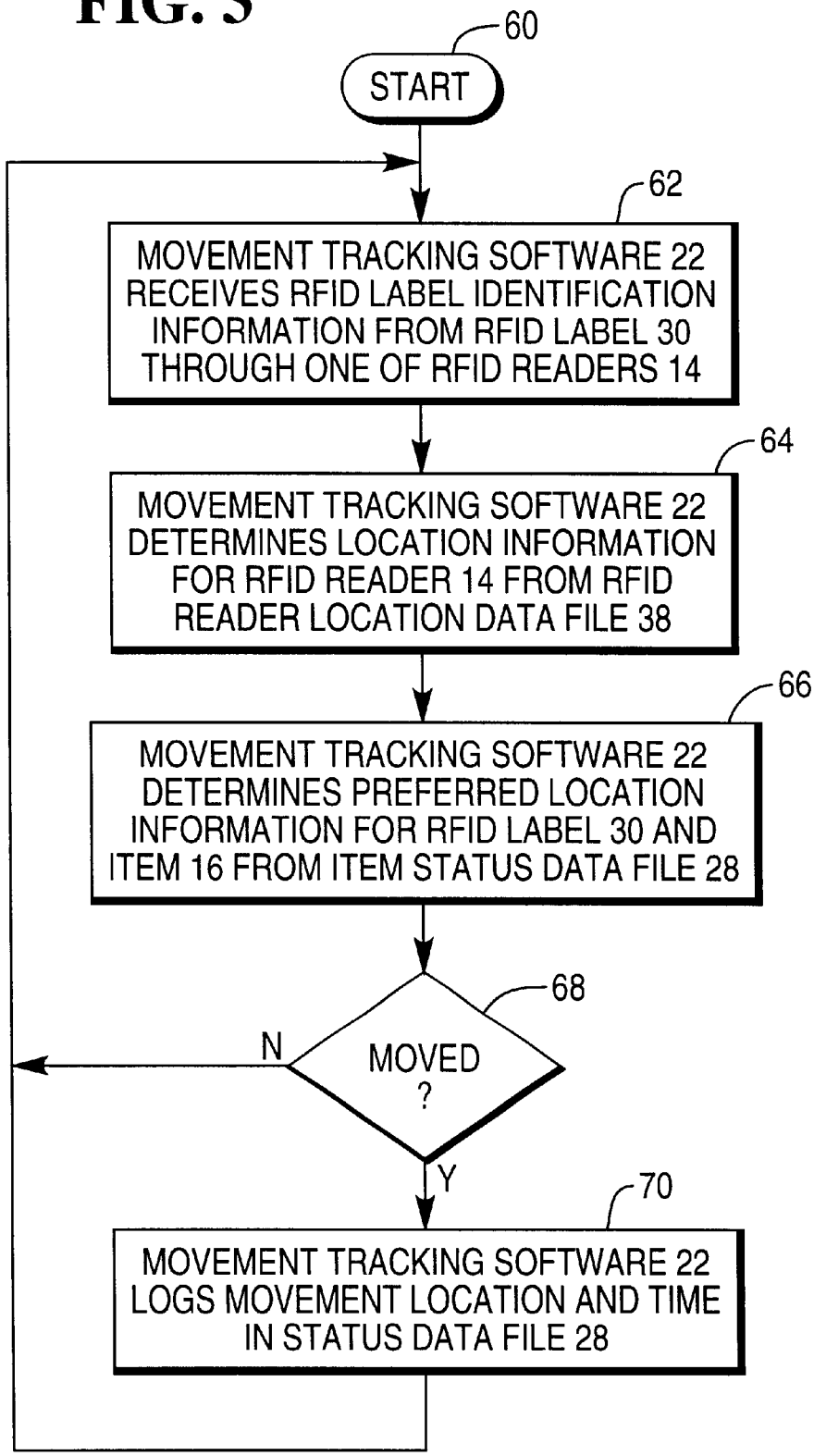
FIG. 3 is a flow diagram illustrating the method of the present invention.

Turning now to FIG. 3, operation is further illustrated in more detail beginning with START 60.

In step 62, movement tracking software 22 receives RFID label identification information from RFID label 30 through one of RFID readers 14.

In step 64, movement tracking software 22 determines location information for RFID reader 14 from RFID reader location data file 38.

In step 66, movement tracking software 22 determines preferred location information for RFID label 30 and item 16 from item status data file 28.

In step 68, movement tracking software 22 determines whether item 16 has been moved. If so, operation continues to step 70. Otherwise, returns to step 62.

In step 70, movement tracking software 22 logs movement location and time in status data file 28 and operation returns to step 62.

A modification of the above procedure involves the extra steps of determining whether item 16 has been moved to an unauthorized location identified in item status data file 28 and issuing an alert only if item 16 has been moved to an unauthorized location.

Another modification of the above procedure involves the extra steps of determining whether item 16 is a recalled product and if so, determining whether item 16 was removed from its preferred location from item status data file 28, and issuing an alert to prevent the sale of item 16 if item 16 has been recalled.

Another modification of the above procedure involves the extra steps of determining whether item 16 has been removed from its preferred location to an exit, determining from item status data file 28 whether item 16 was purchased, and issuing an alert if no payment has been made.

Another modification of the above procedure involves the extra steps of determining whether item 16 has been removed from its preferred location to an exit, determining from item status data file 28 whether item 16 is limited to movement within an office, building, or other defined area, and issuing an alert if item 16 is limited to movement within an office, building, or other defined area.

Another modification of the above procedure involves the extra steps of determining whether item 16 has been removed from its preferred location to an exit, determining from item status data file 28 whether item 16 is limited to movement within an office, building, or other defined area, and logging an exit time in item status data file 28 if item 16 is allowed to leave an office, building, or other defined area.

Although the present invention has been described with particular reference to certain preferred embodiments thereof, variations and modifications of the present invention can be effected within the spirit and scope of the following claims. The present invention also has applicability in tracking other types of items besides retail products and office equipment.

I claim:

1. A method determining improper movement of an item comprising the steps of:

(a) receiving RFID label identification information from an RFID label associated with the item through an RFID reader;

(b) determining a location of the RFID label and the item by determining location information for the RFID reader;

(c) determining a preferred location for the RFID label and the item; and (d) comparing the determined location with the preferred location to determine that the RFID label and the item have been moved.

2. The method as recited in claim 1, further comprising the steps of:

(e) determining whether the determined location is an unauthorized location; and (f) issuing an alert if the determined location is the unauthorized location.

3. The method as recited in claim 1, further comprising the steps of:

(e) determining whether the item is a recalled product; and (f) issuing an alert if the item is the recalled product to prevent sale of the item.

4. The method as recited in claim 1, further comprising the steps of:

(e) determining that the RFID label and the item have been moved to an exit;

(f) determining whether the item was purchased; and (g) issuing an alert if the item was not purchased.

5. The method as recited in claim 1, further comprising the steps of:

(e) determining that the RFID label and the item have been moved to an exit;

(f) determining whether the item is limited to movement within a predetermined area; and (g) issuing an alert if the item is limited to movement within the predetermine area.

6. The method as recited in claim 1, further comprising the step of:

(e) logging a movement time.

7. A method of determining improper movement of a product comprising the steps of:

(a) receiving RFID label identification information from an RFID label associated with the product through an RFID reader;

(b) determining a location of the RFID label and the product by determining location information for the RFID reader;

(c) determining whether the RFID label and the product have been moved to a checkout terminal;

(d) determining whether the item is a recalled product; and (e) issuing an alert if the item is the recalled product to prevent sale of the item.

8. A method of determining improper movement of a product comprising the steps of:

(a) receiving RFID label identification information from an RFID label associated with the product through an RFID reader;

(b) determining a location of the RFID label and the product by determining location information for the RFID reader;

(c) determining whether the RFID label and the product have been moved to an exit;

(d) determining whether the item was purchased; and (e) issuing an alert if the item was not purchased.

9. A method of determining improper movement of an item comprising the steps of:

(a) receiving RFID label identification information from an RFID label associated with the item through an RFID reader;

(b) determining a location of the RFID label and the item by determining location information for the RFID reader;

(c) determining whether the item is limited to movement within a predetermined area;

(d) determining whether the location of the RFID label and the item are outside of the predetermined area; and (e) issuing an alert if the location of the RFID label and the item are outside of the predetermined area.

10. The method as recited in claim 9, further comprising the step of:

(f) logging an exit time if the item is limited to movement within the predetermine area.

11. A method of determining improper movement of an office item comprising the steps of:

(a) receiving RFID label identification information from an RFID label associated with the office item through an RFID reader;

(b) determining a location of the RFID label and the office item by determining location information for the RFID reader;

(c) determining whether the office item is limited to movement within a predetermined area;

(d) determining whether the location of the RFID label and the office item are outside of the predetermined area; and (e) issuing an alert if the location of the RFID label and the office item are outside of the predetermined area.

12. A system for determining movement of an item comprising:

an RFID reader for receiving RFID label identification information from an RFID label associated with the item; and a computer for determining a location of the RFID label and the item by determining location information for the RFID reader, for determining a preferred location for the RFID label and the item, and for comparing the determined location with the preferred location to determine that the RFID label and the item have been moved.

13. A system for determining improper movement of a product comprising:

an RFID reader for receiving RFID label identification information from an RFID label associated with the product through an RFID reader; and a computer for determining a location of the RFID label and the product by determining location information for the RFID reader, for determining whether the RFID label and the product have been moved to a checkout terminal, for determining whether the item is a recalled product, and for issuing an alert if the item is the recalled product to prevent sale of the item.

14. A system for determining improper movement of a product comprising:

an RFID reader for receiving RFID label identification information from an RFID label associated with the product through an RFID reader; and a computer for determining a location of the RFID label and the product by determining location information for the RFID reader, for determining whether the RFID label and the product have been moved to an exit, for determining whether the item was purchased, and for issuing an alert if the item was not purchased.

15. A system for determining improper movement of an item comprising:

an RFID reader for receiving RFID label identification information from an RFID label associated with the item through an RFID reader; and a computer for determining a location of the RFID label and the item by determining location information for the RFID reader, determining whether the item is limited to movement within a predetermined area, determining whether the location of the RFID label and the item are outside of the predetermined area, and for issuing an alert if the location of the RFID label and the item are outside of the predetermined area.

16. The system as recited in claim 15, wherein the computer also logs an exit time if the item is limited to movement within the predetermine area.

17. A system for determining improper movement of an office item comprising:

an RFID reader for receiving RFID label identification information from an RFID label associated with the office item through an RFID reader; and a computer for determining a location of the RFID label and the office item by determining location information for the RFID reader, determining whether the office item is limited to movement within a predetermined area, for determining whether the location of the RFID label and the office item are outside of the predetermined area, and for issuing an alert if the location of the RFID label and the office item are outside of the predetermined area.

* * * * *